US012235007B2

(12) United States Patent
Chen et al.

(10) Patent No.: US 12,235,007 B2
(45) Date of Patent: Feb. 25, 2025

(54) DEHUMIDIFIER WITH COMPENSATION AND CONTROLLING METHOD THEREOF

(71) Applicant: NATIONAL TAIWAN NORMAL UNIVERSITY, Taipei (TW)

(72) Inventors: Wei-Jen Chen, Taipei (TW); Tun-Ping Teng, Taipei (TW)

(73) Assignee: NATIONAL TAIWAN NORMAL UNIVERSITY, Taipei (TW)

( * ) Notice: Subject to any disclaimer, the term of this patent is extended or adjusted under 35 U.S.C. 154(b) by 302 days.

(21) Appl. No.: 17/863,444

(22) Filed: Jul. 13, 2022

(65) Prior Publication Data

US 2023/0408128 A1 Dec. 21, 2023

(30) Foreign Application Priority Data

Jun. 15, 2022 (TW) ..... 111122230

(51) Int. Cl.

| | |
|---|---|
| ***F24F 11/64*** | (2018.01) |
| ***F24F 3/14*** | (2006.01) |
| *F24F 110/10* | (2018.01) |
| *F24F 110/20* | (2018.01) |

(52) U.S. Cl.

CPC ..... *F24F 11/64* (2018.01); *F24F 3/1405* (2013.01); *F24F 2110/10* (2018.01); *F24F 2110/20* (2018.01)

(58) Field of Classification Search

CPC ..... F24F 1/0083; F24F 11/0008; F24F 11/30; F24F 2110/10; F24F 2110/20; F24F 2140/30

See application file for complete search history.

(56) References Cited

U.S. PATENT DOCUMENTS

2019/0293311 A1* 9/2019 Kohashi ..... F24F 11/30

FOREIGN PATENT DOCUMENTS

CN 111637545 B 7/2021

* cited by examiner

*Primary Examiner* — Jonathan Bradford
(74) *Attorney, Agent, or Firm* — Rivka Friedman

(57) ABSTRACT

Disclosed is a dehumidifier with compensation and controlling method thereof. The dehumidifier with compensation includes an environment-adjusting unit, a temperature-detecting unit, a humidity-detecting unit, a temperature-compensation unit and a control unit. The temperature-compensation unit is used to derive a plurality of compensated temperature values of the indoor space by calculating or checking a temperature reference table. The control unit is used to adjust a power of the environment-adjusting unit according to the plurality of compensated temperature values to achieve the target-moisture value.

6 Claims, 3 Drawing Sheets

DEHUMIDIFIER WITH COMPENSATION AND CONTROLLING METHOD THEREOF

FIELD OF THE INVENTION

The present invention relates to a dehumidifier with compensation and controlling method thereof, and, is related to a dehumidifier applied in a field of AC, for improving the conventional dehumidifier.

BACKGROUND OF THE INVENTION

In the conventional dehumidifier, after the user sets the temperature and humidity, the dehumidifier starts to operate until the humidity in the indoor space is consistent with the set target humidity. It does not refer to immovable devices with dehumidification functions such as air conditioners, because the temperature detection unit and humidity detection unit of immovable devices have greater design flexibility, which can avoid the following problems: Generally speaking, most dehumidifiers use a vapor-compression refrigeration cycle, so they need to rely on a temperature detection unit (thermometer) and a humidity detection unit (hygrometer). However, the above two components are limited by Its fragile structure and need be installed inside the dehumidifier, and the internal space of the dehumidifier is limited, the internal temperature of the dehumidifier is always much higher than the external temperature of the dehumidifier during operation. However, the excessively high temperature will also affect the temperature detection unit, so that the measured temperature is much higher than the actual temperature (the external temperature of the dehumidifier), which cannot accurately reflect the real-time temperature at each moment, which will make the dehumidifier not operate in the best way.

Referring to another conventional art (CN 111637545B), the method adopted is to place the dehumidifier in a plurality of different ambient temperatures (known ambient temperatures) in advance to obtain the internal temperature of the dehumidifier (that is, the wrong temperature), to obtain the temperature difference between the internal temperature of the dehumidifier and the ambient temperature under multiple different ambient temperatures; in this way, when the dehumidifier is placed in an unknown environment, the internal temperature of the dehumidifier can be matched with the previously known temperature difference. To get the ambient temperature of the unknown environment, as long as a dehumidifier is changed, it is still necessary to set a thermometer in the environment (external to the dehumidifier) to obtain the temperature difference, and then use the internal temperature of the dehumidifier (that is, the wrong temperature) under the unknown ambient temperature. Then, the unknown ambient temperature (true) is deduced by using the internal temperature of the dehumidifier (that is, the wrong temperature) and the temperature difference under the unknown ambient temperature; in addition, there will be many experimental measure errors in multiple different environments. The ease of effectively reducing pre-testing is also something to consider.

Therefore, there are technical problems in the conventional art: 1. The thermometer is affected by the internal waste heat of the dehumidifier and cannot obtain the correct external temperature of the dehumidifier and the humidity of the hygrometer is also incorrect; 2. Use two thermometers to obtain temperature difference, then deriving the correct ambient temperature; 3. In turn, the dehumidifier cannot operate in the correct (or power saving) way due to incorrect temperature and humidity.

Hence, it is needed to provide a dehumidifier with compensation and the controlling method of using the same, for solving the technical problem.

SUMMARY OF THE INVENTION

The present invention provides an dehumidifier with compensation function, which uses the detected plural simultaneous temperature values and plural simultaneous humidity values to calculate or query a temperature reference table to obtain the plural compensated temperature values (the correct humidity values can be calculated with the correct temperature values). Further, it is avoided that the dehumidifier cannot operate optimally because the hygrometer cannot obtain the correct humidity of the indoor space, thereby shortening the time to reach the target temperature value and/or a target humidity value.

In order to solve the technical problems of the conventional art, the object of the present invention is to provide a dehumidifier with compensation which comprises an environment-adjusting device, a temperature-detection unit, a humidity-detection unit, a temperature-compensation unit, a control unit and at least one heat-generating unit. The environment-adjusting device adjusts an indoor space according to a target humidity value. The temperature-detection unit detects a plurality of simultaneous temperature values of the indoor space. The humidity-detection unit detects a plurality of simultaneous humidity values of the indoor space. The temperature-compensation unit derives a plurality of compensated temperature values by calculating and/or checking a temperature reference table according to the plurality of simultaneous temperature values and the plurality of simultaneous humidity values. The control unit adjusts a power of the environment-adjusting device according to the plurality of compensated temperature values and the target humidity value, to shorten a time achieving to the target humidity value. The at least one heat-generating unit comprises the environment-adjusting device and generates a waste heat.

In one preferred embodiment, the temperature-detection unit is disposed inside the dehumidifier.

In one preferred embodiment, the waste heat touches the temperature-detection unit.

In one preferred embodiment, each of the plurality of compensated temperature values are equal with a sum of C1 multiplies each of the plurality of simultaneous temperature values, C2 multiplies each of the plurality of simultaneous humidity values and C3, wherein C1, C2 and C3 are derived from a plurality of parameters related with the dehumidifier.

In one preferred embodiment, the environment-adjusting device is a type of vapor-compression refrigeration cycle.

In order to achieve the above objective, the present invention further provides a controlling method for an dehumidifier with compensation, which comprises: First, an environment-adjusting device of a dehumidifier adjusts an indoor space according to a target humidity value; then, a temperature-detection unit detects a plurality of simultaneous temperature values; then, a humidity-detection unit detects a plurality of simultaneous humidity values; then, a temperature-compensation unit derives a plurality of compensated temperature values by calculating and/or checking a temperature reference table according to the plurality of simultaneous temperature values and the plurality of simultaneous humidity values; then, a control unit adjusts a power of the environment-adjusting device according to the plurality of compensated temperature values and the target humidity value, to shorten a time achieving to the target humidity value.

In one preferred embodiment, the temperature-detection unit and the humidity-detection unit are disposed inside the dehumidifier.

In one preferred embodiment, the waste heat touches the temperature-detection unit.

In one preferred embodiment, each of the plurality of compensated temperature values are equal with a sum of C1 multiplies each of the plurality of simultaneous temperature values, C2 multiplies each of the plurality of simultaneous humidity values and C3, wherein C1, C2 and C3 are derived from a plurality of parameters related with the dehumidifier.

In one preferred embodiment, the environment-adjusting device is a type of vapor-compression refrigeration cycle.

Compared with the conventional arts, the present invention uses the detected plural simultaneous temperature values and plural simultaneous humidity values to calculate or query a temperature reference table to obtain the plural compensated temperature values. In order to avoid that the hygrometer cannot obtain the correct temperature due to the influence of the internal waste heat of the dehumidifier (the internal temperature of the dehumidifier and the external temperature to be adjusted may differ by several 10 Celsius degrees), and the correct humidity cannot be known (the correct absolute humidity can be obtained through a table or calculation with temperature and relative humidity, the table can be psychrometric chart), which makes the dehumidifier unable to optimize the operation, and thus shortens the time to reach a target humidity value.

DESCRIPTION OF THE DIAGRAMS

DETAILED DESCRIPTION OF THE PREFERRED EMBODIMENTS

The following description of the embodiments is given by way of illustration with reference to the specific embodiments in which the invention may be practiced. The terms such as "up", "down", "front", "back", "left", "right", "inside", "outside", "side", etc., The direction of the diagram. Accordingly, the use of a directional term is used to describe and to understand the present invention and is not intended to limit the invention.

Figure 1:
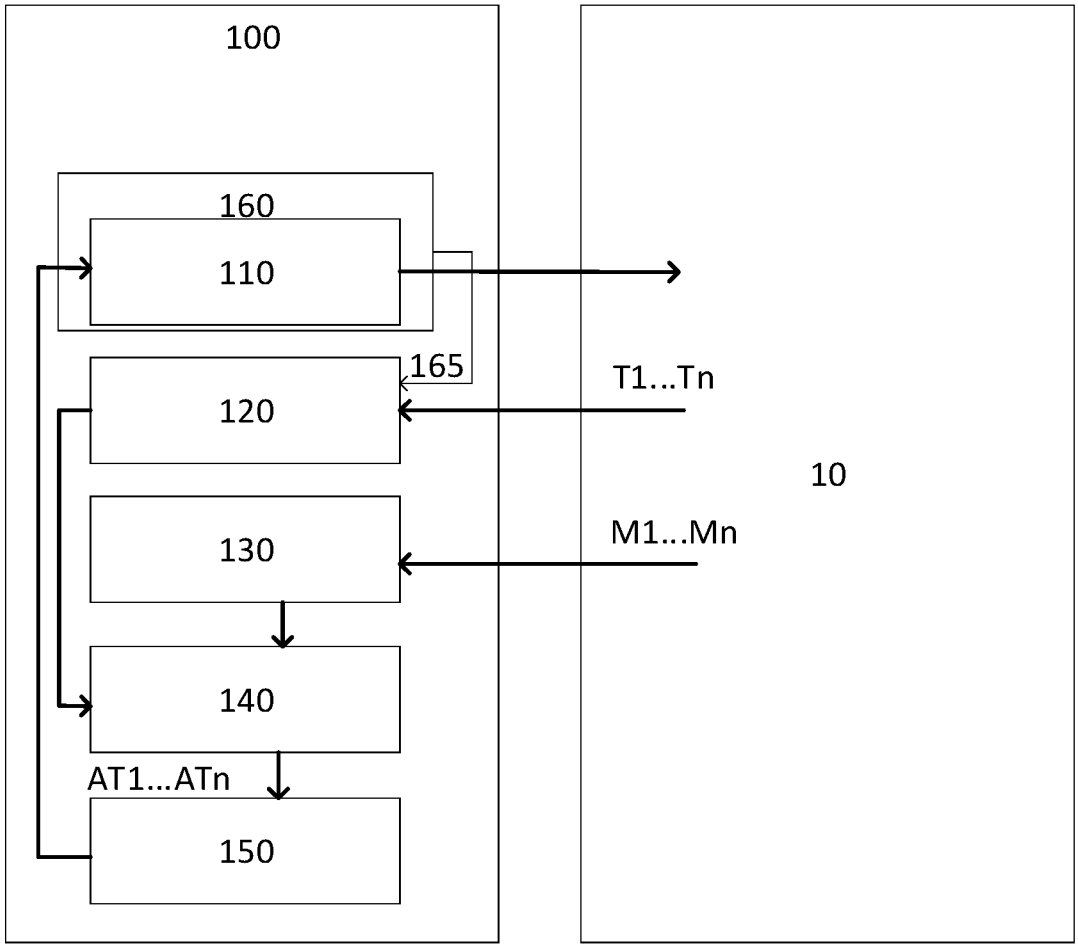
FIG. 1 is a schematic diagram of an indoor space and a dehumidifier of the present invention.
Figure 2:
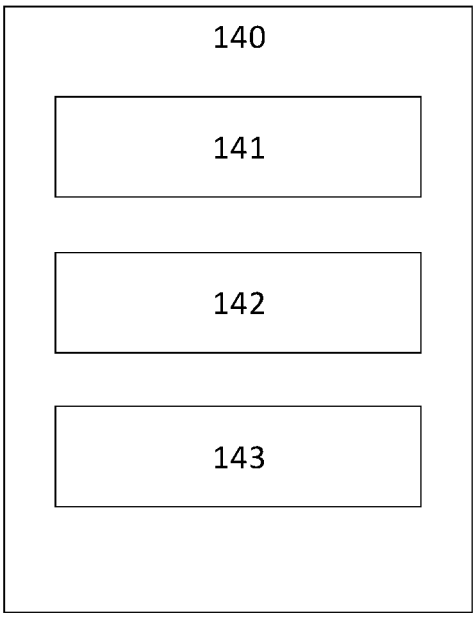
FIG. 2 is a detail schematic diagram of the temperature-compensation unit of FIG. 1.
Figure 3:
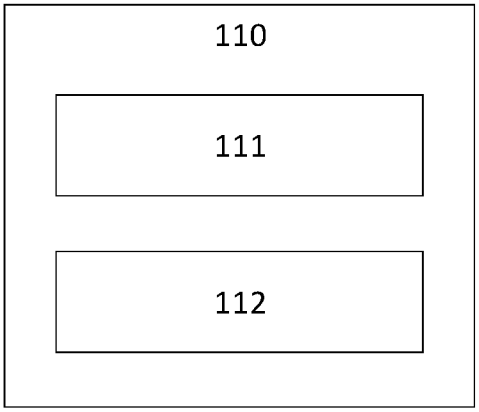
FIG. 3 is a detail schematic diagram of the environment-adjusting device of FIG. 1.

Please refer to FIGS. 1-3. FIG. 1 is a schematic diagram of an indoor space 10 and a dehumidifier 100 the present invention; FIG. 2 is a detail schematic diagram of the temperature-compensation unit 140 of FIG. 1; FIG. 3 is a detail schematic diagram of the environment-adjusting device 110 of FIG. 1; The dehumidifier 100 comprises an environment-adjusting device 110, a temperature-detection unit 120, a humidity-detection unit 130, a temperature-compensation unit 140, a control unit 150 and at least one heat-generating unit 160. It should be noted that the dehumidifier 100 is disposed as the conventional air condition system, which is used to describe the heat-exchange and spatial relationship between the dehumidifier 100 and the indoor space 10, which is not representative of the actual spatial relationship.

The environment-adjusting device 110 adjusts an indoor space 10 according to a target humidity value SH (Setup Humidity, it means relative humidity). The temperature-detection unit 120 detects a plurality of simultaneous temperature values T1 . . . Tn of the indoor space 10. The humidity-detection unit 130 detects a plurality of simultaneous humidity values M1 . . . Mn of the indoor space 10 (it means relative humidity). The temperature-compensation unit 140 derives a plurality of compensated temperature values AT1 . . . ATn (Adjusted Temperature) by calculating and/or checking a temperature reference table 143 (which means Psychrometric Chart) according to the plurality of simultaneous temperature values T1 . . . Tn and the plurality of simultaneous humidity values M1 . . . Mn. Preferably, the temperature-compensation unit 140 comprises a processor 141, a memory 142 and a temperature reference table 143 (The temperature reference table can be omitted, where the plurality of compensated temperature values AT1 . . . ATn could be calculated merely by the processor 141 and the memory 142). The control unit 150 adjusts a power of the environment-adjusting device 110 according to the plurality of compensated temperature values AT1 . . . ATn and the target humidity value SH, to shorten a time of the compensated temperature values ATn achieving to the target humidity value SH. In detail, the power (or the ON/OFF) of the environment-adjusting device 110 is changed according to the plurality of compensated temperature values AT1 . . . ATn and the target humidity value SH. The at least one heat-generating unit 160 comprises the environment-adjusting device 110 and generating a waste heat 165. In detail, the environment-adjusting device 110 will have corresponding change according to the change of the plurality of compensated temperature values AT1 . . . ATn and the target humidity value SH.

The relative humidity and absolute humidity or moisture content mentioned in this manual can be easily converted when the temperature and pressure are known.

Generally speaking, in an environment with only one thermometer and one hygrometer, since the thermometer is arranged inside the dehumidifier 100, the at least one heat-generating unit 160 will generate the waste heat 165 to increase the internal temperature of the dehumidifier 100. The temperature is much higher than the temperature outside the dehumidifier 100 (that is, the actual ambient temperature of the indoor space 10), causing a great error in the temperature value. The present invention obtains the real temperature values (indoor space) by calculating or refer to the table through the existing simultaneous data (temperature and humidity, it should be noted that the temperature and humidity are inside the dehumidifier 100, not the correct temperature and humidity of the indoor space 10). The environment adjustment unit 110 can perform optimal operation under the correct data (power adjustment or switching on and off is possible, but not limited), rather than using incorrect data for operation.

In detail, if the pressure changes, the pressure value can also be included in the calculation (the pressure can also be directly known without delay).

In detail, the temperature reference table 143 is selected from the group consisting of the plurality of simultaneous temperature values T1 . . . Tn and the plurality of simultaneous humidity values M1 . . . Mn, the plurality of compensated temperature values AT1 . . . ATn and the target humidity value SH (when the pressure is different, it is possible to take the pressure as an important factor). The purpose is to only need to calculate or look up a table to obtain the plurality of compensated temperature values according to the temperature and humidity measured inside the dehumidifier 100 and the target humidity value SH.

In detail, each of the plurality of compensated temperature values AT1 . . . ATn is equal to C1× each of the plurality of simultaneous temperature values T1 . . . Tn C2× each of the plurality of simultaneous absolute humidity values (which are derived from the plurality of simultaneous temperature values T1 . . . Tn and the plurality of simultaneous humidity values M1 . . . Mn with the table) C3, wherein C1, C2 and C3 are derived from a plurality of parameters related to the dehumidifier 100 to be put into the following formulas 1~3. Then the control unit 150 can adjust the environment-adjusting device 110 precisely.

$$C_1 = \frac{\dot{m}C_p(\beta - \alpha) + \beta UA}{\beta(\dot{m}C_p + UA)} \quad \text{formula 1}$$

$$C_2 = \frac{-\dot{m}h_{fg}\alpha}{\beta(\dot{m}C_p + UA)} \quad \text{formula 2}$$

$$C_3 = \frac{\dot{m}C_p\alpha}{\beta(\dot{m}C_p + UA)}T_{eva} + \frac{\dot{m}h_{fg}\alpha}{\beta(\dot{m}C_p + UA)}w_{eva} - \frac{\gamma}{(\dot{m}C_p + UA)} \quad \text{formula 3}$$

$Ø_r$=Ambient relative humidity
$P_{w,r}$=Ambient water vapor pressure
$P_{ws,T}$=Saturation water vapor pressure at a given temperature T
$W_r$=Ambient humidity ratio
$W_s$=Humidity ratio at the sensor section (the temperature-detection unit and the humidity-detection unit)
$P_{v,s}$=Water vapor pressure at the sensor section
$P_{a,s}$=The absolute pressure at the sensor section
$P_{a,T}$=The ambient absolute pressure
$Ø_s$=Relative humidity at the sensor section
$E_{ev}$=The total energy in the control volume (sensor section)
$\dot{Q}_{wh}$=Waste heat from the core section to the sensor section
$\dot{Q}_{sn}$=Heat transfer out from the sensor section through the adjacent enclosure area
$\dot{m}_i$=the mass flow rate of intake air
$h_y$=Ambient specific enthalpy of the air
$\dot{m}_e$=the mass flow rate of the air transferred from the sensor section to the core section
$\dot{m}_i=\dot{m}_e=\dot{m}$=the mass flow rate of the air
$h_s$=Specific enthalpy of the air at the sensor section
α=Coefficient to determine the amount of heat transfer (waste heat) from the environment-adjusting device (evaporator, condenser, and compressor) to the sensor section
W=Compressor power input
y=Coefficient to determine the amount of heat transfer (waste heat) from the circulation fan to the sensor section
UA=Overall heat transfer coefficient×heat transfer area
$T_s$=The temperature at the sensor section
$T_r$=Ambient temperature
$C_p$=Specific heat of the air
$\dot{Q}_e$=Total load of the evaporator
$\dot{Q}_s$=Sensible load of the evaporator
$\dot{Q}_l$=Latent load of the evaporator
$T_{eva}$=The temperature of the air leaving the evaporator
$h_{ta}$=Latent heat of evaporation of the air
$w_{eva}$=The humidity ratio of the air leaving the evaporator
β=Coefficient of performance of the dehumidifier
β'=Coefficient of performance of the dehumidifier being employed as a heat pump
$T_r'$=Ambient temperature estimated by the proposed MLR model
$Ø_s'$=Ambient RH estimated by the proposed MLR model The MLR listed above means Multiple Linear Regression. The above parameters can be obtained by testing or calculation by relying on the factory data of each dehumidifier. Therefore, after matching the above parameters, C1, C2 and C3 belonging to each dehumidifier can be easily obtained, then the plurality of simultaneous temperature values T1 . . . Tn (incorrect) and the plurality of simultaneous humidity values M1 . . . Mn (incorrect)can be obtained by the temperature detection unit 120 and a humidity detection unit 130 disposed inside the dehumidifier. Finally, the plurality of compensated temperature values AT1 . . . ATn are derived.

In detail, the plurality of simultaneous temperature values T1 . . . Tn, the plurality of simultaneous humidity values M1 . . . Mn and the plurality of compensated temperature values AT1 . . . ATn are with respect to different time. In other words, when the temperature and humidity in the indoor space 10 are uniform, it is only necessary to collect the data inside the dehumidifier 100 to obtain the plurality of compensated temperature values AT1 . . . ATn according to the above data calculation or corresponding table. Among them, plurality of simultaneous humidity values M1 . . . Mn is the relative humidity.

Preferably, the present invention only needs to use the real-time temperature and real-time humidity inside the dehumidifier 100 to match the parameters mentioned in the above formula (all can be calculated in advance by the parameters of each dehumidifier), and with the known parameters obtained in advance, the real temperature of the indoor space 10 can be obtained immediately through calculation.

In detail, while the dehumidifier of Panasonic (F-Y181 BW Type:B) is adopted in this invention, the parameters (C1, C2, C3) in the formula of this invention: C1=1.01; C2=−2.44; C3=0.55. Accordingly, the 3 parameters are changed with different dehumidifiers.

Preferably, the environment-adjusting device 110 comprises a temperature-adjusting sub device 111 and/or a humidity-adjusting sub device 112 to respectively adjust temperature and humidity of the indoor space 10. In the preferred embodiment, the temperature-adjusting sub device 111 and the humidity-adjusting sub device 112 are working independently. Generally, the temperature-adjusting sub device 111 is much simple element, such as cooler, heater can change the temperature directly; however, the change of humidity is hugely affected by the temperature, so the humidity-adjusting sub device 112 is selected from the group consisting of a condenser, a dehumidification wheel, an isothermal dehumidification device and a humidifier. In one preferred embodiment, the environment-adjusting device 110 can be an vapor-compression refrigeration system (VCRS). However, it is possible to choose a device which will adjust the temperature and the humidity at the same time, not limited by this embodiment.

Figure 4:
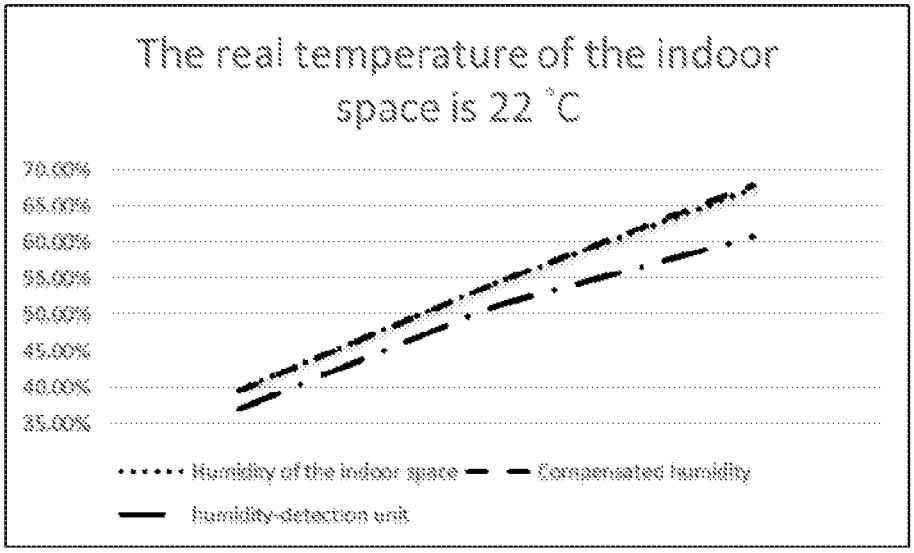
FIG. 4 is an actual test diagram of a dehumidifier according to the present invention.
Figure 4:
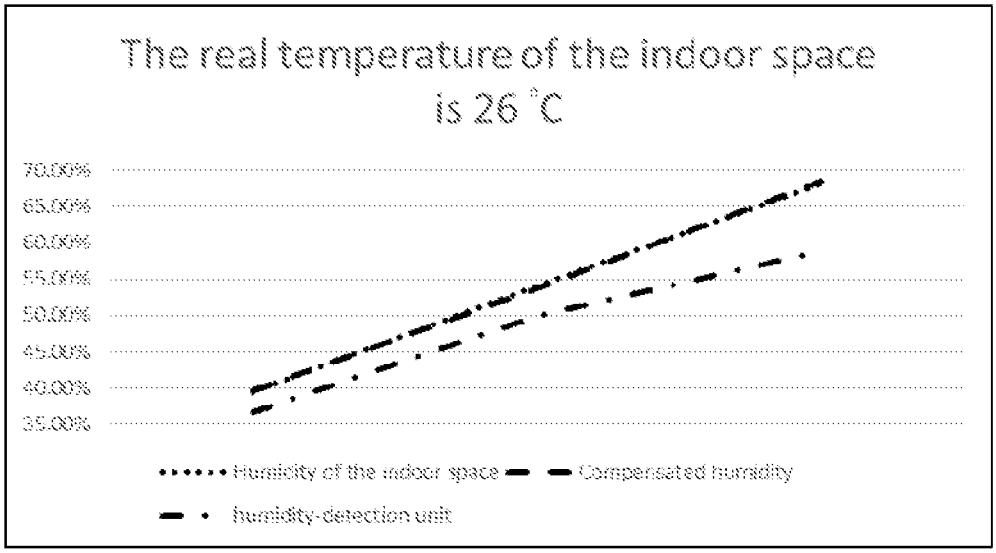

FIG. 4 is an actual test diagram of a dehumidifier 100 according to the present invention. It should be noted here that although the focus of the present invention is to correct the temperature value affected by waste heat, the final operating efficiency of the dehumidifier can be directly referred to whether the humidity is the correct humidity. And this figure is drawn according to Table 1 and Table 2 below.

| The real temperature of the indoor space is 22° C. | | |
|---|---|---|
| Humidity of the indoor space | Compensated humidity | Humidity around the humidity-detection unit |
| 39.60% | 39.53% | 37.00% |
| 54.40% | 54.32% | 51.20% |
| 67.30% | 67.80% | 60.70% |

| The real temperature of the indoor space is 26° C. | | |
|---|---|---|
| Humidity of the indoor space | Compensated humidity | Humidity around the humidity-detection unit |
| 39.40% | 39.69% | 36.60% |
| 54.10% | 53.77% | 49.90% |
| 68.10% | 68.50% | 58.90% |

As can be seen from Table 1 and Table 2, in the indoor space 10 under these two ambient temperatures, the relative humidity measured by the dehumidifier 100 (that is, the humidity at the humidity-detection unit) is lower than the indoor space. The relative humidity of 10 (that is, the indoor space (real) humidity), but the compensated humidity (corrected humidity) obtained after temperature correction is almost the same as the relative humidity of the indoor space 10. Therefore, it can be confirmed that the dehumidifier of the present invention can truly reflect the relative humidity of the indoor space by a method of compensating the temperature.

Figure 5:
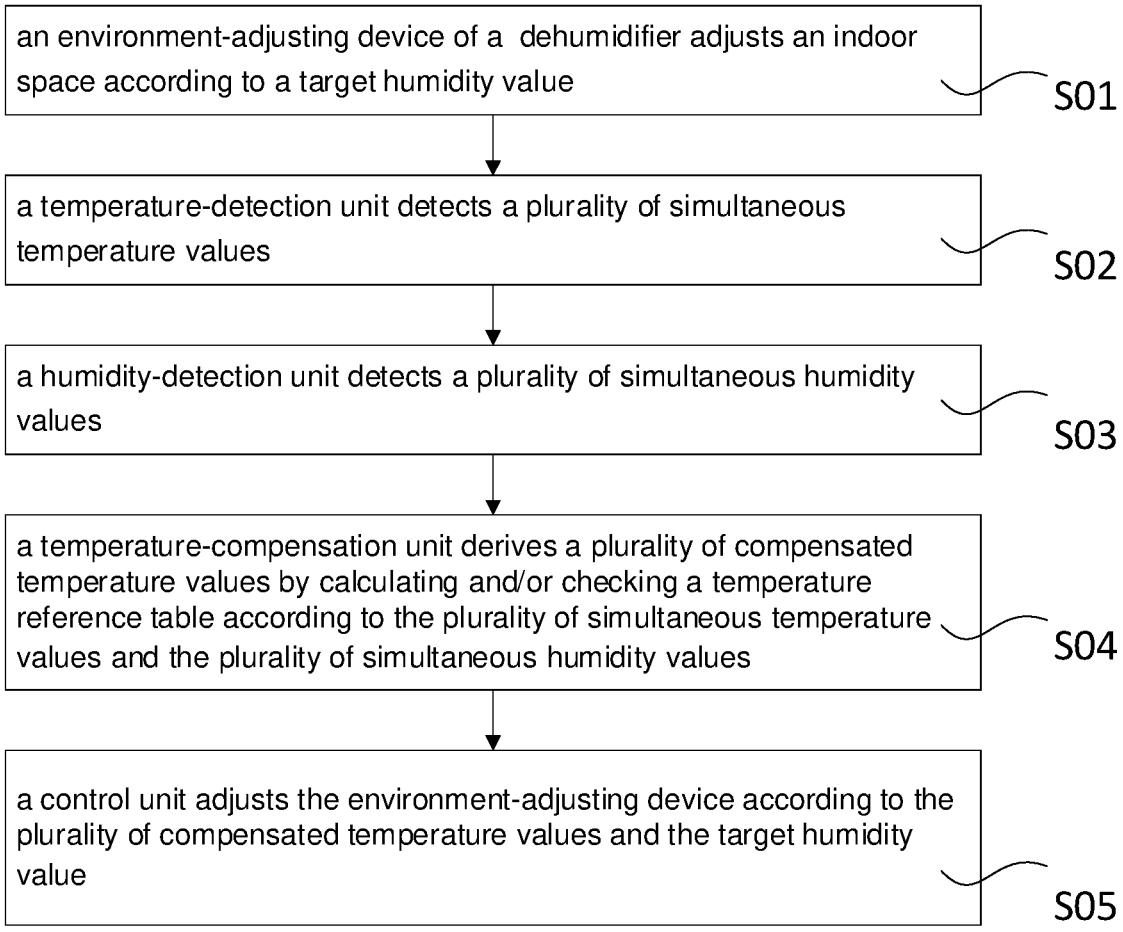
FIG. 5 is a flow diagram of a controlling method for a dehumidifier according to the present invention.

FIG. 5 is a flow diagram of a controlling method for a dehumidifier 100 according to the present invention. The devices and elements used in the flow chart could be referred to FIGS. 1-3 and the above description.

The method comprises: first, the step S01, an environment-adjusting device 110 of a dehumidifier 100 adjusts an indoor space 10 according to a target humidity value SH of the indoor space 10; then, the step S02, a temperature-detection unit 120 detects a plurality of simultaneous temperature values T1 . . . . Tn inside the dehumidifier 100; then, step S03, a humidity-detection unit 130 detects a plurality of simultaneous humidity value M1 . . . . Mn inside the dehumidifier 100; then, the step S04, a temperature-compensation unit 140 derives a plurality of compensated temperature values AT1 . . . . ATn by calculating and/or checking a temperature reference table 143 according to the plurality of simultaneous temperature values T1 . . . . Tn and the plurality of simultaneous humidity values M1 . . . . Mn; finally, the step S05, a control unit 150 adjusts the environment-adjusting device 110 (It's possible to apply adjustment of power or On/Off method, but not limited to this) according to the plurality of compensated temperature values AT1 . . . . ATn to achieve the target humidity value SH.

In detail, the temperature-detection unit 120 and the humidity-detection unit 130 are disposed inside the dehumidifier 100. Hence, the detected information are inside the dehumidifier 100 which is different from the temperature and humidity of the indoor space 10.

Compared with the conventional art, in the present invention, with the plurality of simultaneous temperature values and the plurality of simultaneous humidity values detected inside the dehumidifier, with a formula of the dehumidifier itself which can be calculated in advance or queried a temperature correspondence table, then the plurality of compensated temperature values are derived. This avoids optimal operation due to waste heat making the dehumidifier unable to obtain the correct temperature (and thus the correct humidity).

As described above, although the present invention comprises been described with the preferred embodiments thereof, those skilled in the art will appreciate that various modifications, additions, and substitutions are possible without departing from the scope and the spirit of the invention. Accordingly, the scope of the present invention is intended to be defined only by reference to the claims.

ELEMENT NUMBER DESCRIPTION

10: indoor space
100: dehumidifier
110: environment-adjusting device
111: temperature-adjusting sub device
112: humidity-adjusting sub device
120: temperature-detection unit
130: humidity-detection unit
140: temperature-compensation unit
141: processor
142: memory
143: temperature reference table
150: control unit
160: heat-generating unit
165: waste heat
S01-S05: step
T1 . . . Tn: simultaneous temperature values
M1 . . . Mn: simultaneous humidity values
AT1 . . . ATn: compensated temperature values

What is claimed is:

1. A dehumidifier with compensation, comprising:

an environment-adjusting device, adjusting an indoor space according to a target humidity value of the indoor space;

a temperature-detection unit, detecting a plurality of simultaneous temperature values inside the dehumidifier;

a humidity-detection unit, detecting a plurality of simultaneous humidity values inside the dehumidifier;

a temperature-compensation unit, deriving a plurality of compensated temperature values by calculating and/or checking a temperature reference table according to the plurality of simultaneous temperature values and the plurality of simultaneous humidity values;

a control unit, adjusting a power of the environment-adjusting device according to the plurality of compensated temperature values and the target humidity value, to achieve the target humidity value; and at least one heat-generating unit, comprising the environment-adjusting device and generating a waste heat.

2. The dehumidifier with compensation according to claim 1, wherein the waste heat affects the simultaneous temperature values detected by the temperature-detection unit.

3. The dehumidifier with compensation according to claim 1, wherein each of the plurality of compensated temperature values is equal to C1× each of plurality of simultaneous temperature values C2× each of plurality of simultaneous absolute humidity values C3, wherein each of the simultaneous absolute humidity values can be obtained by looking up a Psychrometric Chart with the plurality of simultaneous temperature values and the plurality of simultaneous humidity values, and C1, C2 and C3 are derived from a plurality of parameters related to the dehumidifier to be put into formulas 1~3:

$$C_1 = \frac{\dot{m}C_p(\beta - \alpha) + \beta UA}{\beta(\dot{m}C_p + UA)} \quad \text{formula 1}$$

$$C_2 = \frac{-\dot{m}h_{fg}\alpha}{\beta(\dot{m}C_p + UA)} \quad \text{formula 2}$$

$$C_3 = \frac{\dot{m}C_p\alpha}{\beta(\dot{m}C_p + UA)}T_{eva} + \frac{\dot{m}h_{fg}\alpha}{\beta(\dot{m}C_p + UA)}w_{eva} - \frac{\gamma}{(\dot{m}C_p + UA)} \quad \text{formula 3}$$

$\dot{m}_i=\dot{m}_e=t\dot{m}$=a mass flow rate of air

α=a coefficient to determine an amount of the waste heat from the environment-adjusting device to the temperature-detection unit and the humidity-detection unit y=a coefficient to determine the amount of the waste heat from the environment-adjusting device to the temperature-detection unit and the humidity-detection unit UA=an overall heat transfer coefficient×a heat transfer area $C_v$=a specific heat of the air $T_{eva}$=a temperature of the air leaving the environment-adjusting device $h_{fc}$=a latent heat of evaporation of the air $W_{eva}$=a humidity ratio of the air leaving the environment-adjusting device β=a coefficient of performance of the dehumidifier.

4. A controlling method for a dehumidifier with compensation, comprising:

adjusting an indoor space according to a target humidity value of the indoor space by an environment-adjusting device;

detecting a plurality of simultaneous temperature values inside the dehumidifier by a temperature-detection unit;

detecting a plurality of simultaneous humidity values inside the dehumidifier by a humidity-detection unit;

deriving a plurality of compensated temperature values by calculating and/or checking a temperature reference table according to the plurality of simultaneous temperature values and the plurality of simultaneous humidity values by a temperature-compensation unit; and adjusting a power of the environment-adjusting device by a control unit according to the plurality of compensated temperature values and the target humidity value, to achieve the target humidity value.

5. The controlling method according to claim 4, wherein a waste heat generated by at least one heat-generating unit affects the simultaneous temperature values detected by the temperature-detection unit, wherein the at least one heat-generating unit comprises the environment-adjusting device.

6. The controlling method according to claim 4, wherein each of the plurality of compensated temperature values is equal to C1× each of the plurality of simultaneous temperature values C2× each of plurality of simultaneous absolute humidity values C3, wherein each of the simultaneous absolute humidity values can be obtained by looking up a Psychrometric Chart with the plurality of simultaneous temperature values and the plurality of simultaneous humidity values, and C1, C2 and C3 are derived from a plurality of parameters related to the dehumidifier to be put into formulas 1~3:

$$C_1 = \frac{\dot{m}C_p(\beta - \alpha) + \beta UA}{\beta(\dot{m}C_p + UA)} \quad \text{formula 1}$$

$$C_2 = \frac{-\dot{m}h_{fg}\alpha}{\beta(\dot{m}C_p + UA)} \quad \text{formula 2}$$

$$C_3 = \frac{\dot{m}C_p\alpha}{\beta(\dot{m}C_p + UA)}T_{eva} + \frac{\dot{m}h_{fg}\alpha}{\beta(\dot{m}C_p + UA)}w_{eva} - \frac{\gamma}{(\dot{m}C_p + UA)} \quad \text{formula 3}$$

$\dot{m}_i=\dot{m}_e=t\dot{m}$=a mass flow rate of air

α=a coefficient to determine an amount of the waste heat from the environment-adjusting device to the temperature-detection unit and the humidity-detection unit y=a coefficient to determine the amount of the waste heat from the environment-adjusting device to the temperature-detection unit and the humidity-detection unit UA=an overall heat transfer coefficient×a heat transfer area $C_v$=a specific heat of the air $T_{eva}$=a temperature of the air leaving the environment-adjusting device $h_{fc}$=a latent heat of evaporation of the air $W_{eva}$=a humidity ratio of the air leaving the environment-adjusting device β=a coefficient of performance of the dehumidifier.

* * * * *